US007125239B2

(12) United States Patent
Grau et al.

(10) Patent No.: US 7,125,239 B2
(45) Date of Patent: Oct. 24, 2006

(54) CONCRETE PIPE MANUFACTURING MACHINERY AND METHODS

(75) Inventors: Thomas D. Grau, South Sioux City, NE (US); Byron M. Hilts, Sioux City, IA (US)

(73) Assignee: International Pipe Machinery Corporation, Sioux City, IA (US)

( * ) Notice: Subject to any disclaimer, the term of this patent is extended or adjusted under 35 U.S.C. 154(b) by 367 days.

(21) Appl. No.: 10/407,771

(22) Filed: Apr. 7, 2003

(65) Prior Publication Data

US 2004/0195725 A1 Oct. 7, 2004

(51) Int. Cl.
*B28B 21/24* (2006.01)

(52) U.S. Cl. ..... 425/193; 425/262; 425/426; 425/460

(58) Field of Classification Search ..... 425/262, 425/425, 193, 426, 427, 457, 460, 470
See application file for complete search history.

(56) References Cited

U.S. PATENT DOCUMENTS 3,096,556 A * 7/1963 Woods ..... 425/262
3,276,091 A * 10/1966 Pausch ..... 425/262
4,407,648 A * 10/1983 Fosse ..... 425/457
4,690,631 A * 9/1987 Haddy ..... 425/262
4,957,424 A * 9/1990 Mitchell et al. ..... 425/457
5,080,571 A * 1/1992 Crawford ..... 425/262
5,364,578 A * 11/1994 Grau ..... 425/262

* cited by examiner

*Primary Examiner*—Duane Smith
*Assistant Examiner*—Thu Khanh T. Nguyen
(74) *Attorney, Agent, or Firm*—James G. Staples

(57) ABSTRACT

A concrete pipe making machine having a packerhead consisting of a rollerhead and a longbottom in which the rollerhead and longbottom are quickly assembleable and disassembleable as a unit from the packerhead drive means with one connector and brought into final adjustment off the machine, said drive means providing no obstruction to the flow of wet concrete toward the compaction area, the speed ratios between the rollerhead and longbottom being infinitely variable, and easily replaceable protective wear rings for precluding erosive deformation of the permanent parts of the machine due to undesired penetration of wet concrete into the longbottom.

9 Claims, 4 Drawing Sheets

CONCRETE PIPE MANUFACTURING MACHINERY AND METHODS

This invention relates generally to the field of concrete pipe manufacturing machinery and methods. It is more specifically directed to the packerhead system of manufacturing concrete pipe of which the disclosures in U.S. Pat. Nos. 4,540,539 and 5,080,571 are exemplary.

BACKGROUND OF THE INVENTION

In the packerhead system of concrete pipe manufacture a packerhead which consists of a rollerhead, or roller assembly, and a trowel, more frequently referred to as a longbottom, are lowered into a circular mold and rotated as they move upwardly, all the while packing wet concrete, which is dropped onto the packerhead, against the inner wall surface of the mold. Although well functioning machines are available which produce good quality pipe, both wire reinforced and non-reinforced, as epitomized by the machine disclosed in U.S. Pat. No. 4,540,539 and further improvements thereon as represented by U.S. Pat. No. 5,080,571, market dynamics require that pipe quality be further improved.

In this connection it is necessary to appreciate that industry engineering and quality standards are continually increasing, particularly with respect to reinforced pipe. As has been well known for many years, when the wire cage which constitutes the reinforcement in a concrete pipe is twisted or otherwise prevented from making a good bond with the concrete, undesirable voids form which will cause the pipe to fail post production D-load testing, which simulates fill soil loading on the pipe, and water pressure testing, or, if the tests are passed, to fail prematurely in the field. The underdesireable voids form due to twisting of the wire cage in the manufacturing process, the twisting resulting from the pressures of the rollerhead and troweling surfaces against the wet concrete, said pressures, when unbalanced, eventually exerting a twisting force on the wire cage. The cage twist phenomena can be substantially reduced by the system disclosed in U.S. Pat. No. 4,549,539 but the relationship of the speed ratios between the rollerhead and the longbottom cannot be controlled precisely enough in current machines to totally eliminate cage twist. More importantly, current systems, due to the lack of precise control of the aforesaid speed relationships, are not well suited to automatic control which, it is now known, produces the most economical and consistently high quality pipe since operator judgment, and possible misjudgment, is eliminated. Further improvements dictated by market pressures include increased production rates, component life increase, and capital investment decrease by increasing the number of sizes of pipes that can be made on a single machine.

SUMMARY OF THE INVENTION

The invention is a concrete pipe making system capable of producing either reinforced or nonreinforced concrete pipe, though its benefits are realized to a greater extent in the production of reinforced pipe. The system includes a method of delivering wet concrete to a packerhead in a more uniform manner so that a steady state flow of wet concrete can be placed against the mold wall by the packerhead, thereby resulting in a very constant and smooth wall thickness free of slight depressions and bulges as is often encountered in current machines.

The invention also includes a unique packerhead which eliminates all obstructions to the feed of wet concrete so that a steady state flow of wet concrete can be presented to the mold wall preliminarily to packing and smoothing by the rollerhead and the longbottom.

A further feature of the invention is an infinitely variable drive system for both the rollerhead and the longbottom whereby optimum rollerhead-longbottom speed ratios can be attained so as to produce pipe which is always within specifications. Of equal importance, such a drive system is ideally adapted to automatic control so that ideal operating conditions (rate of feed, pressure of compaction, etc.) can be consistently maintained and operator error eliminated.

The invention further includes a unitized packerhead which can be assembled and disassembled to the drive system of the machine much quicker than in prior art machines. The saving of time is further increased by the unique design of the packerhead which permits assembly and adjustment of all parts in the packerhead prior to changeover rather than after initial assembly, as is currently the norm.

Another advantage of the invention over existing machines is a marked increase in the life of those component parts of the machine which are subject to wear due to contact with the chemically and physically erosive wet concrete during the pipe manufacturing process, said advantage being achieved by the use of inexpensive, readily attachable and detachable components which are in contact with the wet concrete while at the same time protecting the customized components of the machine.

A further great advantage of the invention, particularly for pipe plants of smaller size, is the expansion of the range of sizes of pipe that can be manufactured on one machine, such as enabling 12" and 15" pipe to be made on a 60" machine, as contrasted to a former minimum pipe size of 18", thereby allowing the pipe plant operator to invest in only one machine instead of two for making the full range of the highly popular 12" to 60" pipe sizes.

BRIEF DESCRIPTION OF THE DRAWING

The invention is illustrated more or less diagrammatically in the accompanying drawing in which.

In the following description of the invention like reference numerals will refer to the same or similar parts from Figure to Figure.

DESCRIPTION OF THE INVENTION

Figure 1:
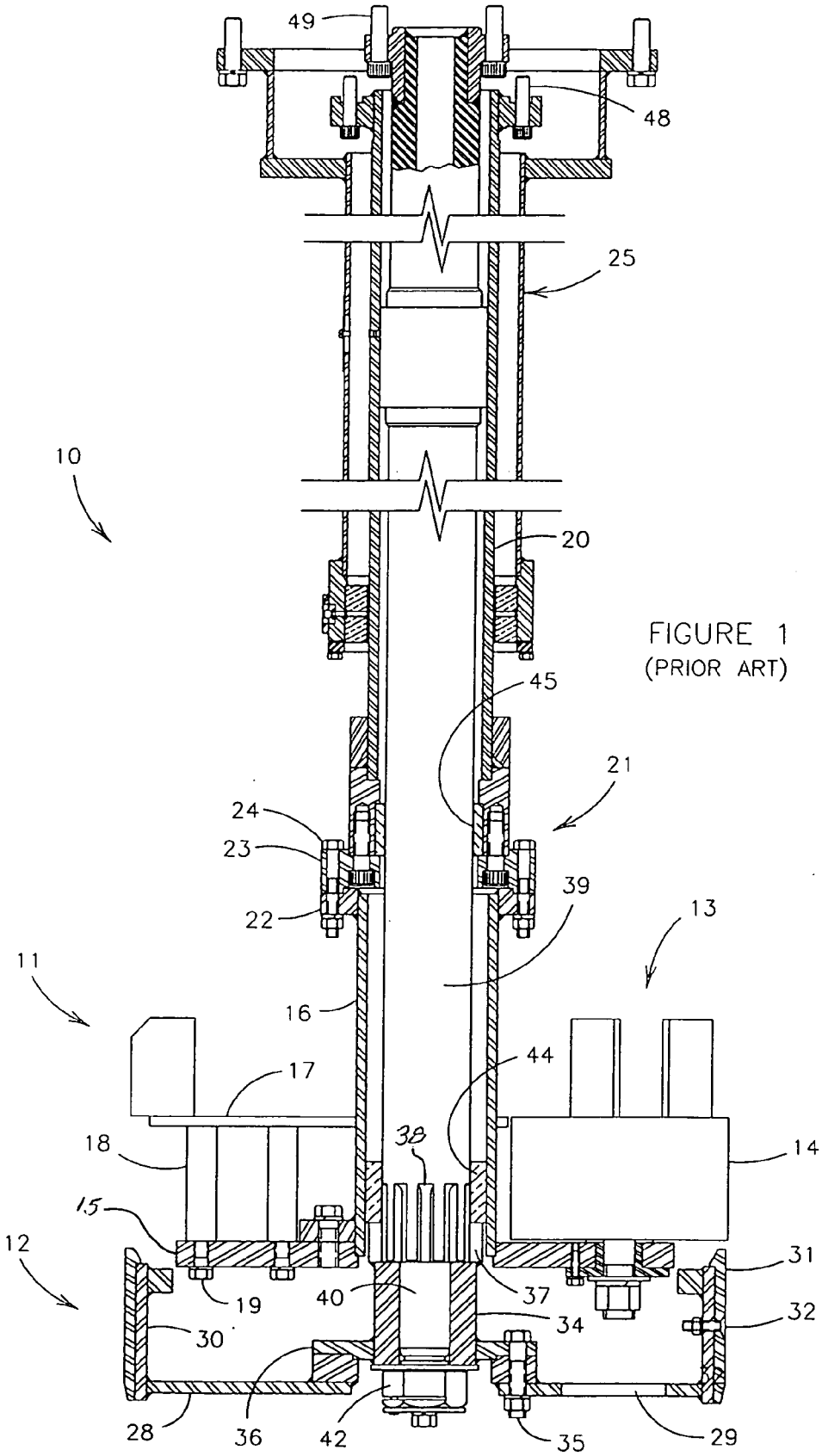
FIGURE 1 (PRIOR ART)
FIG. 1 is a section view with portions omitted for clarity of a counter rotating packerhead in wide use at the time of this invention and over which the present invention constitutes an improvement.

Referring first to FIG. 1, a counter rotating packerhead assembly (hereafter referred to as the packerhead) of the prior art is indicated generally at 10. The packerhead includes a rollerhead assembly, or simply a rollerhead, indicated generally at 11, and a troweling assembly, usually referred to as a longbottom, indicated generally at 12.

The rollerhead 11 includes a roller assembly, indicated generally at 13, which comprises a plurality of smoothing rollers, usually four, one of which is indicated at 14. The rollers 14 are carried by a roller mounting member, here a plate 15, which is fast with lower drive tube 16. A roller hood which occupies the spaces between the rollers 14 is indicated at 17, the function of the roller hood being to intercept wet concrete fed from above before it drops below the tops of rollers 14 and, also, to ensure radially outward flow of the wet concrete toward the inner wall of the mold, not shown. The roller hood 17 is spaced from the roller mounting plate 15 by a plurality, here eight, support pins 18 which are removeably secured to the roller mounting plate 15 by bolts 19 and, at their upper ends, welded to the underside of the roller hood 17.

The rollerhead further includes an upper drive tube 20, the upper and lower portions of the drive tube being connected by flange means 21 consisting of a lower flange 22 surrounding the upper end of lower drive tube 16, an upper flange 23 surrounding the lower end of upper drive tube 20 and bolts 24 which connect the upper and lower drive tubes 20 and 16.

A protective enclosure is indicated generally at 25 surrounding the upper end of the upper drive tube 20.

The longbottom 12 includes a circular bottom plate 28 having apertures 29 therein for access to rollers 14. A circular mounting flange is indicated at 30 at the extremity of bottom plate 28, the mounting flange carrying a smooth, circular troweling member 31 which is secured entirely around the periphery of the mounting flange by any suitable fastening means, here recessed bolts 32. The troweling member 31 is usually composed of a plurality of individual sections, each of which is contoured, when assembled, to form a circular outer periphery.

The circular bottom plate 28 is connected to a stub sleeve 34 by bolts 35 and flange 36 which is fast with the stub sleeve 34. A spline ring having an internal spline is indicated at 37 extending upwardly from stub sleeve 34. The splined ring 37 mates with an external spline 38 located near the bottom of the longbottom drive shaft 39. The lowermost end 40 of drive shaft 39 is received in the bore in stub sleeve 34. Drive shaft 39 is secured to longbottom plate 28 by nut 42 which is screwed onto the threaded end of drive shaft 39, bushings 44 and 45 space the longbottom drive shaft 39 from the lower drive tube 16 and the upper drive tube 20 of rollerhead 11.

The upper ends of upper drive tube 20 and shaft 39 are secured by bolts 48, 49 respectively to stationary supporting structure and a drive system which powers drive tube 20 and drive shaft 39. For an understanding of supporting structure which is suitable for both the prior art disclosure of FIG. 1 and the invention disclosed herein, reference is made to U.S. Pat. No. 4,540,539 and particularly FIG. 1 thereof.

Figure 2:
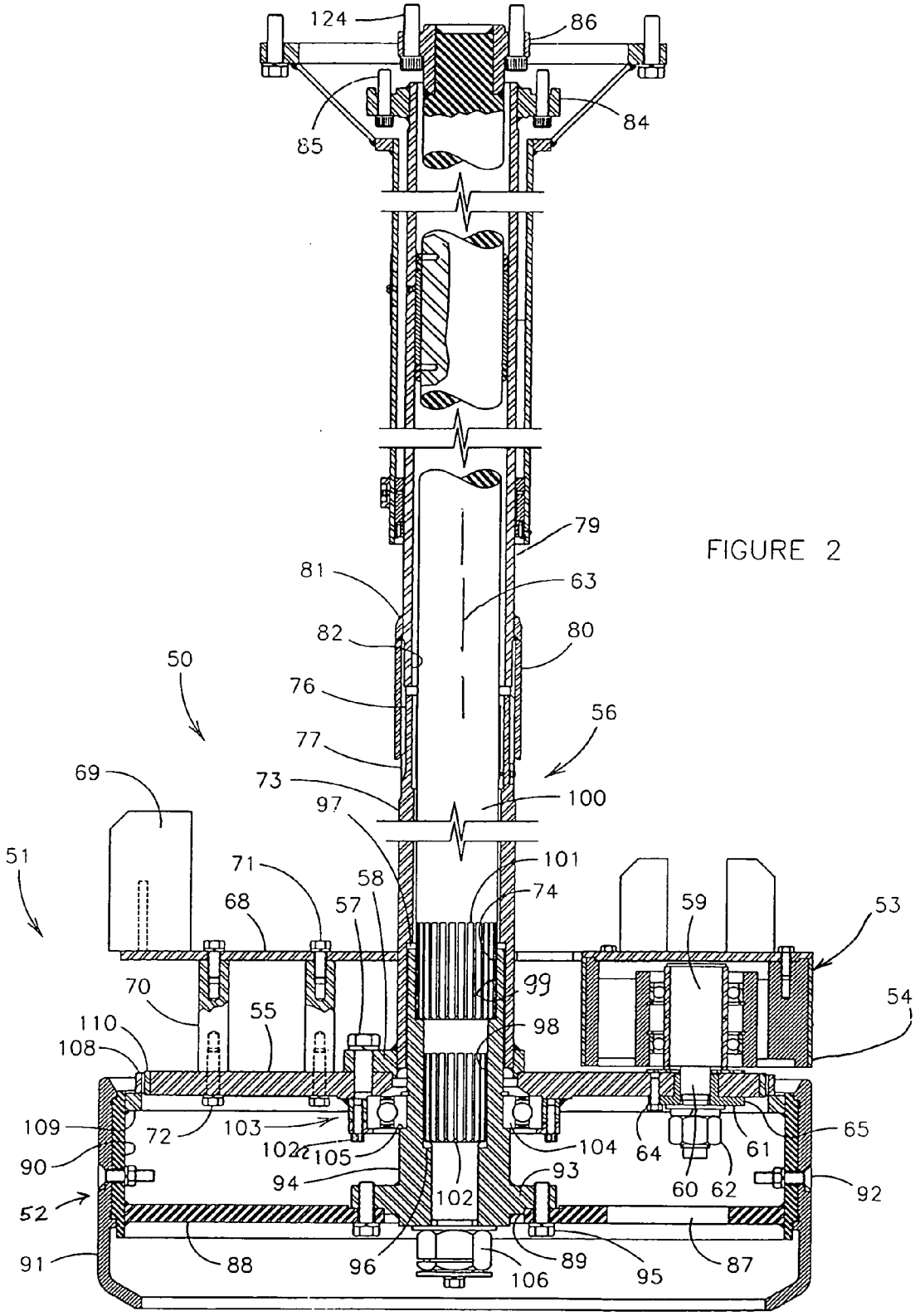
FIG. 2 is a section view with parts omitted for clarity of the packerhead of this invention, here a counter rotating packerhead.

Referring now to FIG. 2 the packerhead of this invention is indicated generally at 50. The packerhead includes a rollerhead indicated generally at 51, and a longbottom, indicated generally at 52.

The rollerhead 51 includes a roller assembly, indicated generally at 53, which comprises a plurality of smoothing rollers, here four, one of which is indicated at 54. The rollers 54 are carried by a roller mounting member, here a plate 55 which is secured to lower drive tube assembly 56, hereafter sometimes referred to as a second drive assembly, by bolts 57 which connect the drive tube assembly flange 58 to an inner circle of threaded holes in roller mounting plate 55.

The roller 54 is mounted on a bearing supported shaft 59 whose lower portion 60 is received in an eccentric bearing 61, the rotatable shaft 59 being secured to the roller mounting plate 55 by nut 62. It will be understood that in operation it is desirable that the edge of the smoothing roller 54 in contact with the freshly layed up wet concrete be at the same radial distance from the axial center line 63 of the packerhead as is the periphery of the longbottom 52, and, on occasion depending on circumstances, even at a slightly greater radial distance. From an examination of the eccentric bushing 61 it will be seen that the wall thickness of the bushing varies so that the outer, concrete contacting surface of roller 54 can be moved radially inwardly and outwardly depending on the rotative relationship between the bushing 61 and roller mounting plate 55 derived from the placement of radial adjustment bolts 64 in the bottom flange 65 of bushing 61. Often the operator desires that the concrete contacting surface of roller 54 project radially outward from axis 63 a slightly greater distance than the periphery of longbottom 52.

A roller hood is indicated at 68, the hood 68 being essentially a circular flat plate with radially located round cutouts to accommodate the rollers, the top surface of the roller hood 68 preferably being co-planar with the top surface of the rollers 54. Wet concrete distributing blades 69 are welded to and extend upwardly from the roller hood 68.

Roller hood 68 is connected to and fixedly spaced from mounting plate 55 by support pins 70. Upper bolts 71 secure the roller hood 68 to the upper ends of pins 70 and lower blots 72 secure the lower ends of pins 70 to the mounting plate 55.

Roller mounting plate connecting flange 58 projects outwardly from the lower portion 73 of the second drive assembly 56. The bottom interior bore of lower portion 73 is recessed as at 97 to snugly, but rotatably, receive the upstanding portion of the longbottom drive system, sometimes hereafter referred to as a first drive assembly, as will be more fully explained hereafter. A very slight clearance exists between the outside of lower portion 73 of the second drive assembly and the center hole, unnumbered, in the roller hood 68, the clearance being sufficiently large to preclude any binding between the two components but close enough to preclude fresh wet concrete from penetrating past the roller hood 68.

The lower portion 73 of the second drive assembly 56 extends upwardly a short distance to its top end, indicated generally at 76. An external spline 77 is formed on the upper end of lower portion 73.

Figure 3:
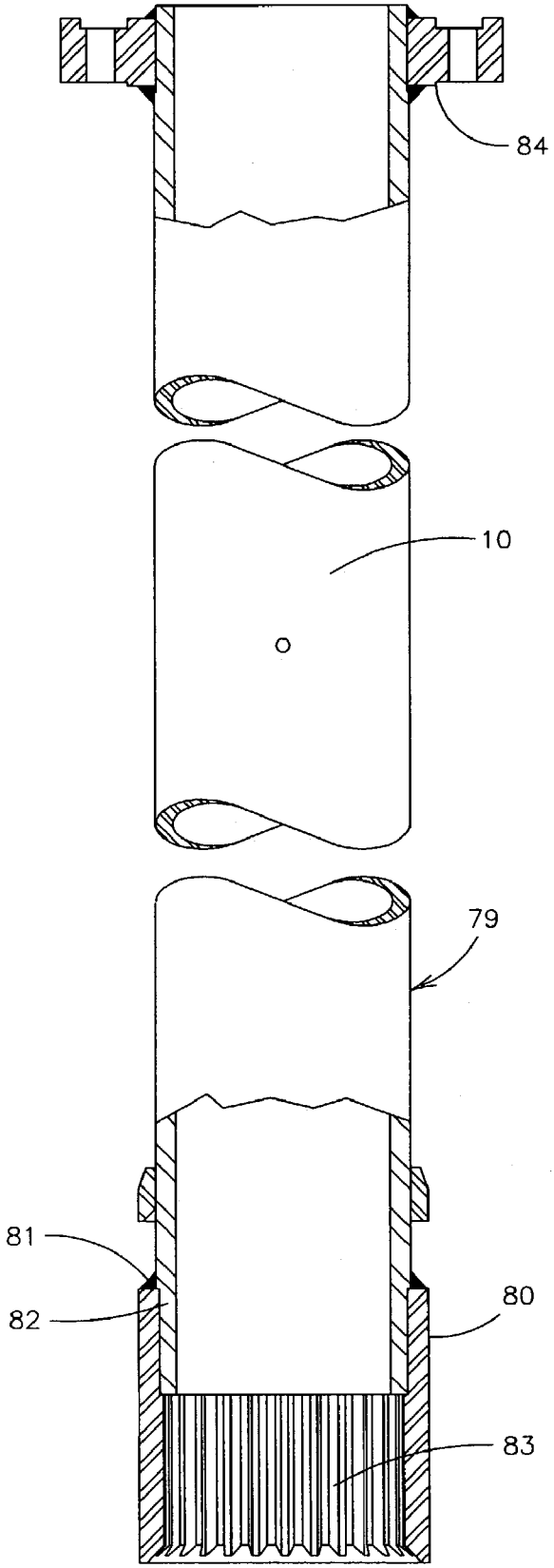
FIG. 3 is a side elevation with portions omitted and others broken away for clarity of the outer packer tube which drives the roller assembly of the present invention.

The upper portion of second drive assembly 56 is indicated at 79, see FIG. 3 as well. A drive transfer sleeve 80 is welded as at 81 to the lower end portion 82 of upper portion 79. An internal spline 83, see FIG. 3, is formed on the internal surface of lower end portion 82, said internal spline 83 matching the external spline 77 on lower portion 73.

The upper end of upper portion 79 terminates in a top flange 84 which is secured by bolts 85, see also FIG. 4, to the stationary support structure described earlier and the drive system to be described hereinafter.

Longbottom 52 includes a mounting member, here a circular bottom plate 88, having center mounting hole 89. A circular mounting flange is indicated at 90 at the periphery of the bottom plate 88, the mounting flange carrying a smooth circular trowel means 91 which is secured entirely around the periphery of mounting flange 90 by a suitable fastening means, here recessed bolts 92. The trowel means 91 is usually composed of a plurality of individual sections, each of which is contoured, when assembled, to form a circular outer periphery.

The bottom plate 88 is connected to a flange 93 on the bottom end portion of spline socket 94 by bolts 95. Plate 88 is a horizontal plate that is part of the longbottom frame. The plate has openings 87 cut in it that are oriented to the roller locations. The roller mounting assembly and longbottom assembly can be rotated in respect to each other so that the openings 87 in plate 88 are aligned with the rollers. It is therefore possible to access the bottom nut 62 of the roller and remove it without disassembling the two main rollerhead assembly components or having to remove the entire unit from the machine.

Openings 87 also allow the following:

Access to the eccentric bushings 61 of the rollers for radial position adjustment when necessary, while the unit is still assembled;

Access to the bearing outside housing screws 102 to allow disassembly of the two main units;

Enable any concrete slurry that passes between the wear plates 108, 110, of the mountings to flow out through plate 88 of the longbottom frame;

Weight reduction without affecting the strength significantly of the longbottom frame.

Spline socket 94 extends upwardly inside the recess 97 in the lower portion of the drive tube assembly 56 in a snug fitting, non-binding relationship so that the spline socket 94 and lower portion 73 of drive tube assembly 56 can rotate relative to one another. A lower internal recess in spline socket 94 is indicated at 96 and an upper larger internal recess is indicated at 96*a*. Recess 96 has an internal spline 98, and recess 96*a* has an internal spline 74.

A first drive assembly for rotating the longbottom includes a longbottom drive shaft 100 which extends through the roller mounting member 55. An upper external spline is indicated at 101, said upper spline mating with the upper internal spline 74 on the spline socket 94.

A lower external spline is indicated at 102, said lower spline mating with the internal spline 98 in the lower socket recess 96 of spline socket 94. Although in this instance two spline and socket systems have been illustrated on the single drive shaft 100, it is preferable that the upper spline system be used to drive larger sized longbottom assemblies and the lower spline system be used to drive smaller sized longbottom assemblies. In other words, the spline socket 94 may carry only one internal spline, the location of the spline depending on the size of the longbottom.

An important feature of the invention is that the packerhead 50 is unitized in the sense that the rollerhead 51 beginning with the roller hood 68 and the longbottom 52 are one piece, and only a single connection step is needed to change from one packerhead, say a 12" size, to another packerhead size, say a 60" size, or vice versa, or any combination of sizes between the extremes the machine is designed to use. This will become apparent from the following description.

Referring to FIG. 2 a large sealed bearing is indicated generally at 103. The bearing 103 is secured to the underside of roller mounting plate 55 by bolts 102*a*. The inner race 104 of the bearing seats on an external ledge 105 in spline socket 94. The parts are assembled as illustrated in FIG. 2 by screwing drive shaft nut 106 onto the bottom, threaded end of longbottom drive shaft 100. To disassemble, the nut 106 is unscrewed and both the longbottom 52 and the rollerhead 51 are slid off the drive shaft 100 as a unit, thereby making possible an exceedingly quick change of packerheads either for reasons of a need to make a different size pipe or to service the initial packerhead while a duplicate packerhead is assembled as a replacement. These changes are accomplished by putting on or taking off a single component, nut 106, and the removed packerhead can be worked on at leisure and without requiring down time on the machine. From the foregoing description it will be clear that the term packerhead is used herein to mean a longbottom, represented by bottom plate 88, which rotates in a first direction, and a roller head, represented by roller mounting plate 55, which rotates in an opposite direction.

Alternatively, to disassemble rollerhead 51 from longbottom 52, the bolts 102*a* in bearing 103 of the outer housing can be removed. These screws can be accessed through the openings in plate 88, or bolts 95 can be removed dropping the longbottom 52 from the unit. Unless there is a specific reason for doing different, the preferred way is to remove fasteners 95 rather than risk possible contamination or damage to bearing 103 by removing the outside housing retainer.

Other important features of the invention are (i) its capability to far more effectively compensate for wear and (ii) drastically reduce jamming of the rollers due to the presence of wet concrete which seep around the rollers and into the interior of the rollerhead 51.

Referring to FIG. 2 a wear ring 108 composed of a hard, wear resistant material, such as manganese steel, is tack welded to a base ring 109 which in turn is welded to the upper inside rim portion of mounting flange 90 so that the ring 108 moves with the longbottom.

A second wear ring, or band, is indicated at 100, said second wear ring being tack welded to the external periphery of mounting plate 55. It therefore moves with the roller assembly 51. The radial gap between the two rings is fixed at the optimum spacing which, for many mixes, is on the order of about ⅛ inch. This spacing precludes the entry of wet concrete, which has momentarily slipped below the bottom of rollers 54, from penetrating into the interior of longbottom 52 from whence it could foul the ball bearing 103 or otherwise interfere with the performance of the machine, particularly the rollerhead 51 by causing the rollers to jam up.

It should be understood that only one specific type of material is ideal for all sizes of rings 108 and 110. In this connection, material cut from hot rolled chrome-moly steel plate stock of medium hardness having a significant manganese content and a Brinnell hardness diameter in the range of 212–255 will be quite satisfactory. This type of alloy steel, known by the trade name AR, has been used in such applications as a chute lining for gravel sand, cement, grain, clay and mud. For even tougher, higher strength applications, a similar chromium, molybdenum and manganese steel which is available under the trade name Kromite will give good performance. Such a steel may have a Brinnell hardness diameter of about 360, and even, as the application requires, up to 400 which is considerably more abrasion resistant than the AR type steel.

The width of the rings or wear bands will most usually be on the order of about 3/16" to 3/8" depending on the viscosity and composition of the wet concrete. A typical width which is suitable for a very wide number of applications is ¼". For smaller rollerheads, such as the 12" or 18" size and possibly even the 24" size, a width of about 3/16" will be quite satisfactory.

When the type and composition of the two wear bands acting jointly are appropriately matched to the application, the wear problem, which was encountered in the cold rolled 1018, 1020 and A-36 type steel bands used in the machine disclosed in U.S. Pat. No. 5,080,571, were eliminated.

Figure 4:
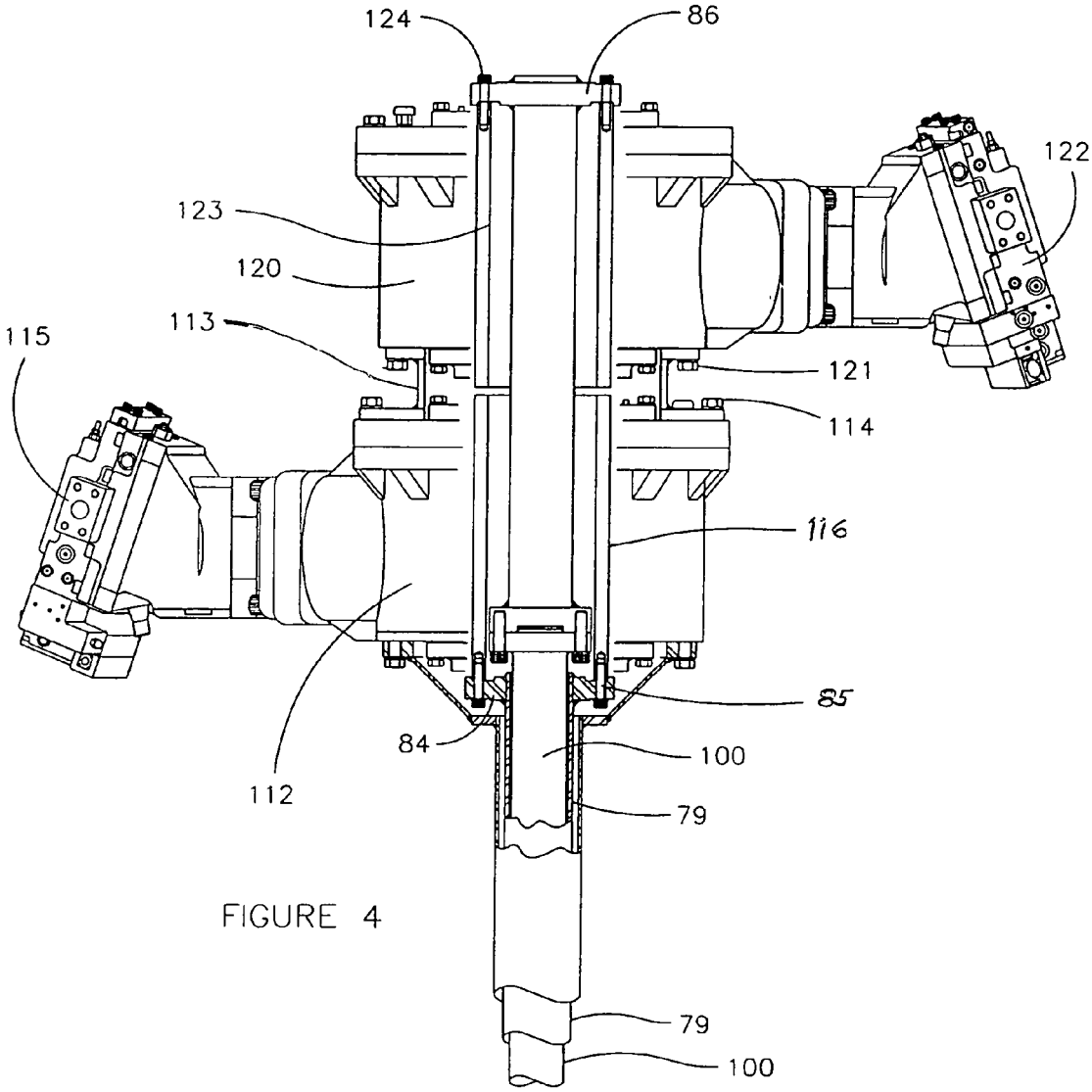
FIG. 4 is a side elevation with portions broken away for clarity of the infinitely variable dual drive system of the present invention.

The feature of adjusting the twisting forces exerted by the rollerhead assembly 51 and the longbottom 52 on the freshly layed up and still wet concrete, and thereby on the wire reinforcement cage encased therein, is illustrated in FIGS. 2 and 4.

Referring to FIG. 4 primarily, a rollerhead drive gear box is indicated at 112, said gear box 112 being bolted to and spaced underneath the stationary support structure 113 by bolts 114. The gear box 112 is driven by a variable displacement speed hydraulic motor 115 which in turn is powered by an electronics driven variable displacement hydraulic pump circuit.

The outer shaft of the rollerhead drive gear box 112 is represented schematically at 116. Bolts 85 connect the top flange 84, see also FIG. 2, of the upper portion 79 of the drive tube assembly 56 to the output shaft 116 of the rollerhead gear box 112. Since the output of the hydraulic motor 115 is infinitely variable within the maximum system operating parameters, including, as required rotation in opposite directions, the speed of rotation of the drive tube assembly 56, and thereby the roller assembly 53, may be infinitely varied.

A longbottom drive gear box is indicated at 120, said gear box 120 being bolted to the stationary support structure 113 by bolts 121. The longbottom gear box 120 is driven by a variable hydraulic motor 122 which in turn is powered by a hydraulic circuit and the electric motor in a conventional manner as earlier referred to.

The output shaft of the longbottom drive gear box 120 is represented schematically at 123. Bolts 124 connect the top flange 86, see also FIG. 2, of the upper end of the longbottom drive shaft 100 to the output shaft 123 of the longbottom gear box 120. Since the output of the hydraulic motor 122 is infinitely variable within the maximum system operating parameters, including, as required, rotation in opposite directions, the speed of rotation of the longbottom drive shaft 100, and thereby the longbottom 52, may be infinitely variable.

Such a dual, infinitely variable hydraulic drive system lends itself to automatic control which results in consistent production of quality pipe on the machine.

The use and operation of the invention are as follows.

The manufacture of reinforced concrete pipe will be assumed since this type of pipe represents the most stringent and demanding operation of the pipe machine. In the reinforced pipe process it will be remembered that a circular cross-section wire cage composed of vertical stringers and circular rings of reinforcing wire are embedded within the wall of the concrete pipe. The concrete must completely envelope the wires because a close, contacting bond between the wire and the set up concrete must be achieved to avoid deficient performance of the pipe in use. Stated another way, there must be no voids between the wire cage and the concrete, due primarily, to uncompensated twisting forces of the wet concrete on the wire cage during manufacture; cage twist must be zeroed out as discussed in greater detail in U.S. Pat. No. 4,540,539.

Since every pipe production operation never runs a given pipe production machine continuously on one size of pipe, and even those that have long runs require periodic checking and cleaning, the machine must be shut down periodically to remove a used packerhead and install a fresh packerhead.

At the current time the shut down, removal and reinstallation is a lengthy process. To disassemble the conventional prior art packerhead of FIG. 1 for example longbottom drive shaft nut 42 must be removed and the longbottom 12 slid off longbottom drive shaft 39. Thereafter bolts 24 must be removed to drop the rollerhead assembly 11. To reinstall, the above described steps must be repeated in reverse order. However said steps cannot be simply repeated sequentially because the positioning of the rollers 14 must be done while the rollerhead assembly 11 is in its illustrated position, but prior to the further assembly of the longbottom to its drive shaft. Adjusting the rollers 14 is difficult and time consuming. All the while the reassembly of the rollerhead assembly, its adjustment, and the reassembly of the longbottom are taking place the machine is out of production. In today's highly competitive environment, down time results in lost production which eventually equates to lost revenue and lost profits.

In the system of this invention by contrast it is only necessary to remove one component, drive shaft nut 106, to slide the entire packerhead, that is, the rollerhead assembly 51 and longbottom 52, simultaneously off the drive system. The moment the first packerhead is removed, a replacement packerhead can be assembled by threading one component, drive shaft nut, 106, back onto drive shaft 100 and production resumed. If the removed packerhead requires readjustment or repair, that can be done in the plant's repair shop while the replacement packerhead is producing pipe. And of course the replacement packerhead will have been adjusted to the exact operating condition desired before it is assembled to the drive system. Of significance in the quick disassemble/assemble operation is the flexibility in making adjustments attributable to bearing 103. Thus after the packerhead 51 is disassembled the longbottom 52 may be separated from the rollerhead 51 and conveniently reworked separately from the rollerhead. It may for example be only necessary to replace the longbottom wear ring 108, and after this is done the packerhead is ready for quick reassembly.

If on the other hand it is necessary to adjust the radial spacing of the rollers with respect to the central axis 63 this can be easily done because roller shaft nuts 62 are easily accessible as contrasted to having to work upwardly through the apertures 29 in the longbottom plate 28 of the prior art construction of FIG. 1.

A further advantage of the present invention is the ability to quickly disassemble and reassemble the rollers only for cleaning. Since pin 18 in the prior art configuration of FIG. 1 is welded to hood 17, the entire rollerhead 51 must be removed to allow cleaning of the rollers 14. Fasteners, or upper bolts 71 now provide easy removal of roller hood 68, only, whereby the rollers can be cleaned without removal of the rollerhead 51 from its drive system. As a result, the roller cleaning time has been considerably reduced, and potential damage of the components attributable to assembly and disassembly has been eliminated.

It should also be noted that entry of wet concrete into the interior of the longbottom can be easily prevented without any degradation of any custom designed operating part of the longbottom. Although the use of a wear ring to impede the leakage of wet concrete into a longbottom has been tried, wear invariably occurred on one or more of the expensive, custom designed permanent operating components of the machine, resulting in its replacement and consequent substantial part replacement expense and production down time. By contrast in the system of this invention, whichever one, or both, of wear rings 108 and/or 110 require replacement, such replacement can be quickly accomplished by tack welding and the machine is immediately back into operation—with all the original, customized parts totally and permanently unaffected by contact with the erosive concrete.

The invention provides a significant increase in the feed of wet concrete in machines of all sizes. Concrete feed to the rollerhead for internal forming of the pipe wall in the machine is done by using a conveyor which drops the concrete to the center of the rollerhead down along the perimeter of the drive shaft. The bolted flange means 21 on the prior art construction of FIG. 1 was a restricting factor on the amount of concrete that can be effectively dropped into the formation area formed by the top of roller hood 17 and the rollers 14. In the present invention the elimination of the obstructing flange means 21 eliminates the prior significant obstruction and provides much better concrete flow into the compaction area. Elimination of the impediment to flow is derived from the use of the splined connections illustrated best in FIGS. 2 and 3 at 77 and 83.

A further significant contributing factor to the greatly improved consistency of the final product and increased production per unit of time is shown in FIGS. 2 and 4. In all known prior art systems only incremental speed steps for the drive system are possible. As a consequence a premium is placed on operator skill to produce consistently acceptable product because other operating factors, such as rate of feed of the wet concrete, have to be made to accommodate operational changes which cannot be achieved, by comparison, by the somewhat crude drive speed control systems currently in use. This problem is completely eliminated by the layering of one infinitely variable drive speed control for one component in the packerhead onto the other infinitely variable control of the other component in the packerhead. Thus, as best visualized from FIG. 4, the speed of both the longbottom and the rollerhead can be set to any desired ratio. This is especially useful in the counter rotating packerhead system because, even if one of the rotating components is infinitely variable, the step-only adjustment of the other rotating component would not produce the optimum speed relationships to produce high quality pipe in a high output pipe plant.

The illustrated system has the further advantage of being ideally suited to automated production in which operator expertise is greatly reduced in importance. Thus, once the final product specifications are known and the characteristics of the raw materials and their mixture ratios are decided, the parameters can be dialed into the control console and the plant started up with the assurance that the first pipe and the last pipe in any run will be of the same uniform acceptable quality.

Although a specific embodiment of the invention has been illustrated and described it will be apparent to those that modifications can be made within the skill of the art. Accordingly it is intended that the scope of the invention be limited only by the scope of the hereafter appended claims in light of the relevant prior art.

The invention claimed is:

1. In a non-vibratory counter rotating packerhead concrete pipe making machine a packerhead, said packerhead having a rollerhead and a longbottom, said rollerhead having a plurality of rollers mounted on a roller mounting member, a longbottom located beneath the rollerhead, said longbottom having a trowel means mounted on a longbottom mounting member, drive means for said packerhead, said drive means including a first drive assembly extending through the roller mounting member into driving engagement with the longbottom for rotating the longbottom in a first direction of rotation, a second drive assembly located above the longbottom in driving engagement with the rollerhead for rotating the rollerhead in a second direction of rotation or in the same direction of rotation as the longbottom but at a dissimilar speed, and fastening means for securing the longbottom to said first drive assembly whereby upon removal of said fastening means the rollerhead and the longbottom can be assembled to, and disassembled from, the drive means as a unit.

2. The non-vibratory concrete pipe making machine of claim 1 further characterized in that the fastening means is a single component which secures the longbottom to the first drive assembly whereby, upon release, the longbottom and the rollerhead can be removed as a unit from the pipe making machine.

3. The non-vibratory concrete pipe making machine of claim 2 fiber characterized in that the first drive assembly includes a first drive member in driving engagement with the longbottom, the second drive assembly includes a second drive member in driving engagement with the rollerhead, said drive members being co-axial with one another.

4. The non-vibratory concrete pipe making machine of claim 3 further characterized in that one of the drive members is a tube assembly and the other drive member is an elongated member within the tube assembly.

5. The non-vibratory concrete pipe making machine of claim 4 further characterized in that the drive means for the rollerhead is a tube assembly.

6. The non-vibratory concrete pipe making machine of claim 4 further characterized in that the drive member for the long bottom is a shaft, the lower end of which receives the fastening means.

7. The non-vibratory concrete pipe making machine of claim 3 further characterized in that each drive assembly includes an infinitely variable speed power source whereby the speed ratio between the rollerhead and the longbottom may be infinitely varied.

8. The non-vibratory concrete pipe making machine of claim 5 further characterized in that the tube assembly includes separable upper and lower sections, said upper and lower sections being connected by a spline whereby no significant obstruction is presented to concrete flow from a point of entry of the concrete above the spline to a compaction area below the spline.

9. The non-vibratory concrete pipe making machine of claim 1 further including connecting means for connecting the rollerhead to the longbottom whereby, upon disconnection of the connecting means, the longbottom can be disassembled from the rollerhead.

* * * * *